United States Patent [19]

Plagenhoef

[11] 4,153,249

[45] May 8, 1979

[54] BIOENGINEERED GAME RACKET

[75] Inventor: Stanley C. Plagenhoef, Amherst, Mass.

[73] Assignee: Motion Analysis, Inc., Amherst, Mass.

[21] Appl. No.: 803,128

[22] Filed: Jun. 3, 1977

[51] Int. Cl.[2] ..... A63B 49/04

[52] U.S. Cl. ..... 273/73 C; 273/75

[58] Field of Search ..... 273/29 A, 73 R, 73 C, 273/73 F, 73 G, 73 H, 73 J, 75, 77 A

[56] References Cited

U.S. PATENT DOCUMENTS

| | | | |
|---|---|---|---|
| 1,539,019 | 5/1925 | Nikonow | 273/73 R |
| 2,164,631 | 7/1939 | Abell | 273/73 H |
| 2,395,864 | 3/1946 | Geerlings et al. | 273/73 J |
| 3,568,290 | 3/1971 | Carlton | 273/73 C X |
| 3,801,099 | 4/1974 | Lair | 273/73 C |
| 3,833,219 | 9/1974 | Dean | 273/75 |
| 3,913,911 | 10/1975 | Peterson | 273/73 C |
| 4,058,312 | 11/1977 | Stuff et al. | 273/77 A |

FOREIGN PATENT DOCUMENTS

| | | | |
|---|---|---|---|
| 848826 | 8/1970 | Canada | 273/73 C |
| 1526906 | 4/1968 | France | 273/73 J |
| 310350 | 4/1929 | United Kingdom | 273/73 C |
| 310566 | 5/1929 | United Kingdom | 273/73 C |

*Primary Examiner*—Richard J. Apley
*Attorney, Agent, or Firm*—Charles Hieken

[57] ABSTRACT

A standard size tennis racket has a flex of substantially 1.2 centimeters at the throat, 2.4 centimeters at the head center and 5.8 centimeters at the tip when a force of substantially thirty pounds is applied to the racket tip with the racket cantilevered from the handle end. A weight between 15 and 25 grams is located on one side on the frame at the midpoint of the strings, and a weight of between 15 and 25 grams is placed at the end of the handle, the weights being concentrated in as small an area as possible, the total weight of the racket counting the side weight only being substantially the same as a conventional unweighted racket. For a 27 inch racket, the weights are selected to establish a center of gravity between $12\frac{3}{4}$ inches and 13 inches from the end of the handle and the center of percussion between 22 and $22\frac{1}{2}$ inches from the end of the handle determined by using a pivot point $4\frac{3}{4}$ inches from the end of the handle. The side weight is preferably as close to the heavy end of the range as possible without having the center of gravity move above 13 inches, and the end weight is selected not only to keep the center of gravity below 13 inches, but to maintain the center of percussion within the stated range. Preferably, the grip on the handle allows the player to hold the racket in the correct portion with the side weight up without looking at the racket, being flat on the thumb side with a bulge to fill the palm $2\frac{1}{4}$ inches up from the end and a rounded area $4\frac{1}{4}$ inches up on the palm side.

9 Claims, 3 Drawing Figures

BIOENGINEERED GAME RACKET

BACKGROUND OF THE INVENTION

The present invention relates in general to game rackets and more particularly concerns novel apparatus and techniques for providing a game racket that is especially compatible with the mechanics of the human arm while requiring relatively little additional structure that is inexpensive and easy to add to a conventional game racket while materially improving performance.

It is an important object of the invention to provide an improved game racket.

It is another object of the inventionto achieve the preceding object with a game racket especially compatible with the mechanics of the human arm.

It is a further object of the invention to achieve one or more of the preceding objects with but a slight mechanical modification of conventional game rackets.

It is still a further object of the invention to achieve one or more of the preceding objects with a game racket that is especially comfortable to use by players.

It is a further object of the invention to provide an improved game racket that reduces strain on the players' arms.

SUMMARY OF THE INVENTION

According to the invention, first weight means is located on one side only of the game racket frame, preferably substantially along a midline midway between the ends of the game racket head and second weight means is located substantially at the end of the handle of the game racket, said first weight means and said second weight means coacting for establishing the center of gravity and the center of percussion spearated by said midline about the same distance therefrom, the center of gravity preferably being spaced from the handle end by a distance slightly less than half the length of the game racket and the center of percussion being spaced from the handle end by substantially 5/6 the racket length. Preferably the first weight means is between 15 and 25 grams and preferably nearer 25 grams. Preferably the second weight means is between 15 and 25 grams. Preferably the weight of the racket and the first weight means according to the invention corresponds substantially to the weight of a conventional comparable racket without the first and second weight means. Preferably, the game racket structure is stiffer between handle and throat than between handle and head end.

Numerous other features, objects and advantages of the invention will become apparent from the following specification when read in connection with the accompanying drawing in which:

DETAILED DESCRIPTION OF PREFERRED EMBODIMENTS

Figure 1:
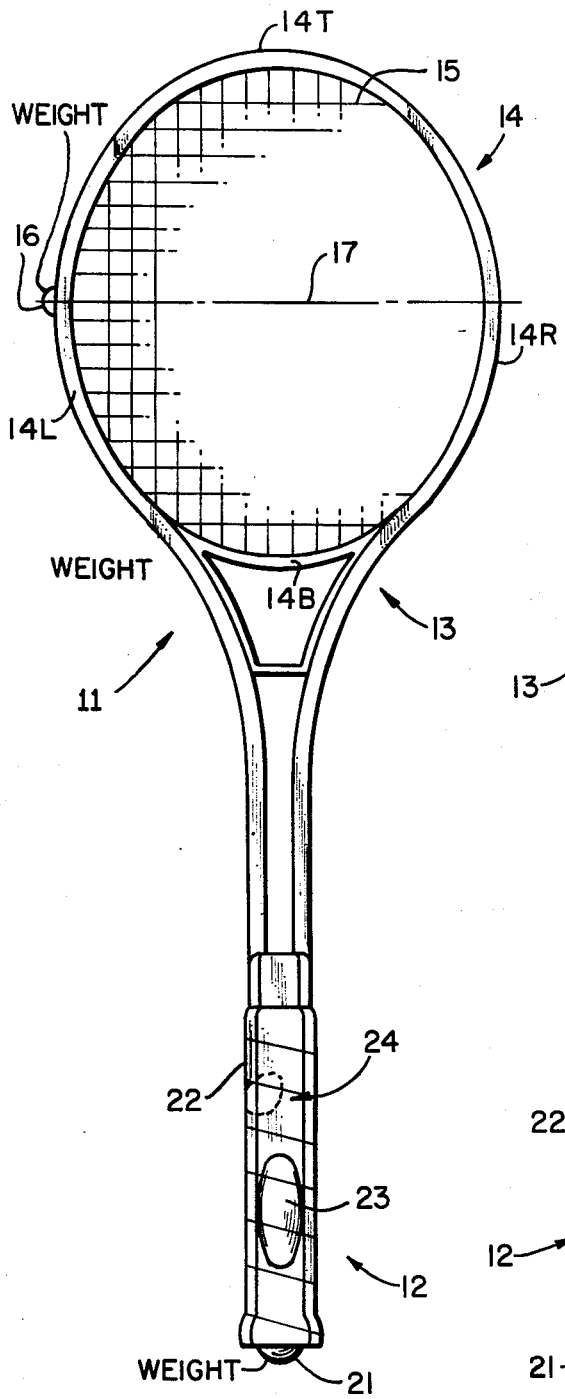
FIG. 1 is a plan view of a game racket weighted according to the invention.

With reference now to the drawing and more particularly FIG. 1 thereof, there is shown a plan view of a game racket according to the invention. The game racket may be a conventional aluminum racket such as the commercially available Acro aluminum racket 11 having a handle portion 12, throat portion 13 and head portion 14 strung with strings 15. Head portion 14 has a top 14T, a bottom 14B near throat portion 13 and two sides 14L and 14R. A side weight 16 is located on one side 14L only of the head embracing midline 17. A handle weight 21 is located at the end of handle portion 12. Side weight 16 and end weight 21 are preferably between 15 and 25 grams, side weight 16 preferably being as near 25 grams as practical while coacting with end weight 21 to establish the center of gravity of game racket 11 spaced from the end of handle portion 12 by a distance slightly less than half the length of the racket and the center of percussion substantially 5/6 the length of the game racket. Game racket 11 is held by the player with side weight 16 up. Handle weight 21 is preferably symmetrically disposed about the axis of the racket. While side weight 16 and handle weight 21 are shown protruding, it is within the principles of the invention to imbed these weight in the frame.

Figure 2:
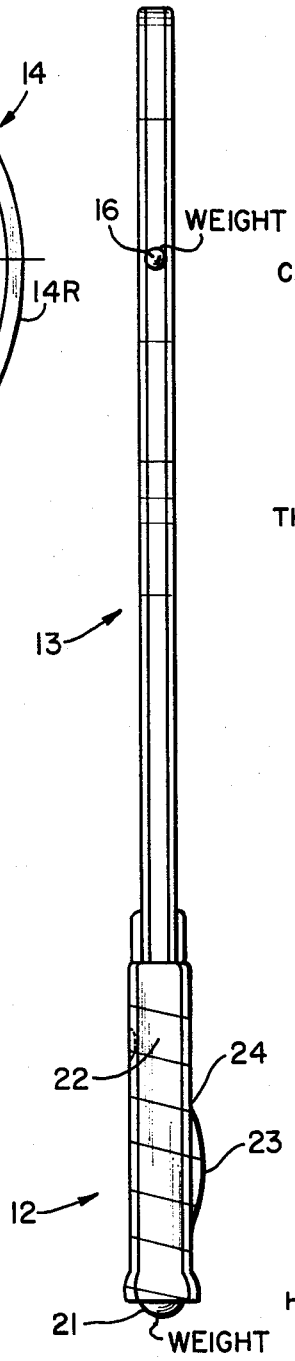
FIG. 2 is a side view of the racket of FIG. 1 showing a preferred form of handle according to the invention.
Figure 3:
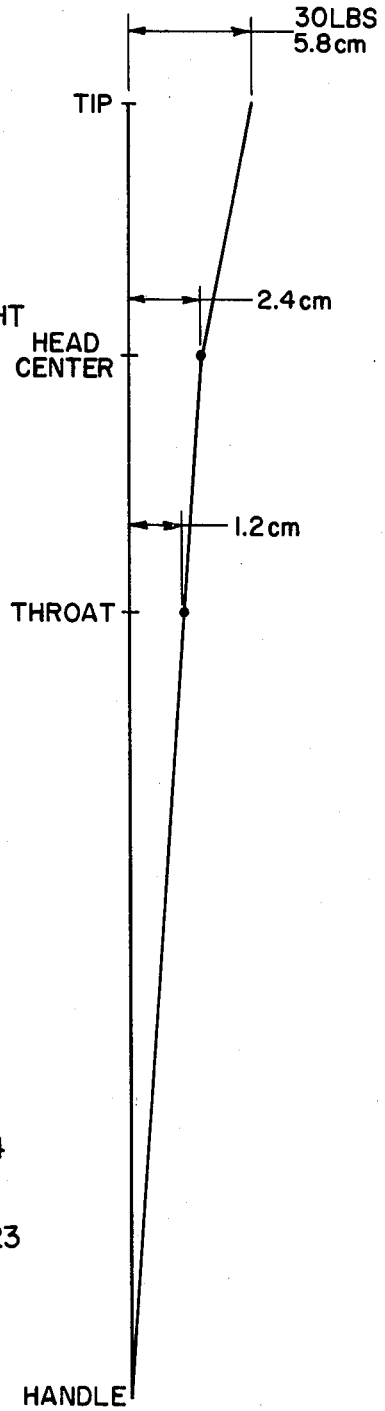
FIG. 3 is a diagrammatic representation of the preferred flexure characteristics of a game racket according to the invention.

Referring to FIG. 2, there is a side view of the racket showing handle portion 12 preferably formed so that the player may hold the racket in the correct position with side weight 16 up without looking at the racket. To this end the handle portion is flat on thumb side 22, has a bulge 23 about $2\frac{1}{4}$ inches up from the end and a rounded recess 24 about $4\frac{1}{4}$ inches from the end on the palm side. The specific techniques for making this handle are known in the art and may comprise, for example, molded plastic parts especially shaped to conform to the human hand. The exemplary embodiment illustrated is for right-handed players, bulge 23 and rounded recess 24 being on the opposite side for a left-handed player.

Referring to FIG. 2, there is shown a diagrammatic representation of the preferred racket flex pattern. With the handle end fixed and a force of 30 pounds applied to the tip of the head of a 27-inch game racket, the tip deflects 5.8 centimeters, the head center along center line 17 deflects 2.4 centimeters and the throat portion 13 deflects 1.2 centimeters.

Having described the structural arrangement of the invention, the principles of operation will be described, particularly relative to the anatomy of the arm and types of typical strokes.

Keeping the center of gravity closer to the handle end than conventional rackets results in providing both a good initial feel to the player and proper balance to produce the preferred center of percussion above midline 17 so that ball impact produces a combination of rotation and translation. Rotation alone causes the racket to revolve about the base of the index finger, and the hand controls the entire movement. By hitting a ball inside of the center of percussion, the base of the hand receives a portion of the racket movement to reduce the muscle forces across the wrist joint slightly and thus the pull on the epicondyles, the bone protrusions at the end of the humerus.

A ball hit off center ordinarily produces the largest forces at impact requiring correspondingly great muscle action. Side weight 16 reduces the torque resulting from impact in those directions that would require forces to be exerted on the lateral epicondyle. Contrary to normal thinking that an off-center hit turns the racket around the long axis of the racket, in fact an off-center hit revolves the racket about the edge further from the point of impact. That is to say, a forehand hit with the ball toward the top edge revolves the racket about the bottom edge. By locating the side weights 16 on one edge only and in a manner to protect the lateral epicondyle, the racket exhibits not only more stability but is less conducive toward producing "tennis elbow". Consider the following types of hits.

(1) Forehand—the pronators of the forearm counter a ball hit high off center. Pronators are weaker than the supinators, and the main supinator (biceps) does not attach to an epicondyle. Side weight 16 is properly located at the top to reduce the counterforce which the forearm pronators must produce.

(2) Forehand—the supinators of the forearm counter the forces caused by a ball hit low off center. Because of their strength and the bony attachments, they provide adequate counterforce without uncomfortable strain, and a weight tending to reduce the required counterforce on the bottom is not required.

(3) Forehand—a ball hit toward the tip of the racket head ordinarily places an undue stress on the flexors of the hand that is reduced by having the high center of percussion located relatively close to the tip according to the invention.

(4) Backhand—the natural forearm roll prior to impact is supination. A ball hit high off center produces a force requiring added resistance from the supinators. However, ball impact also tends to produce forces bending the wrist and requiring use of hand extensors. These extensors attach to the lateral eipcondyle of the elbow which is the weak link and the main source of "tennis elbow". The side weight 16 being on top is helpful in aiding the extensors while the stronger supinators do not require aid.

(5) Backhand—a ball hit low off center produces forces tending to keep the natural roll of the forearm continuing. The pronators counter the impact. Although the weight should be on the bottom to assist the pronators, it is more important to aid the extensors of the hand because of the extent of extensor origins on the lateral epicondyle. The side weight 16 on top provides this assistance.

(6) Service—the server swings the racket across the ball from the inside outward at differing degrees for all serves. The natural movement of the total arm is continued medial rotation of the shoulder joint (Gleno-humeral) and pronation of the forearm. Forces produced by any off center hits to the outside continue this motion and are resisted by the supinators. Any ball struck off center to the inside produces forces requiring the use of pronators. Side weight 16 is then on the inside at the preferred location for assisting the weaker pronators and providing the most help anatomically.

The foregoing analysis establishes the relationship of the placement of side weight 16 to the anatomical use of the forearm as always upward with the grip not changed when not serving. For this reason, handle portion 12 is preferably shaped as shown so that the player always holds the racket with side weight 16 properly positioned without looking.

The overall racket flex pattern is important from the standpoint of performance and injury. A stiff frame aids in obtaining ball velocity so the frame through the throat 13 is preferably stiff. The large forces on the arm occur on off center hits and on hits near the top of the head. By providing as much flexibility in the upper half of head 14 above center line 17 as practical without weakening the frame reduces these undesired forces on the arm without appreciably affecting playability.

Acceptable prototypes have been made for a 400 gram racket with side weight 16 20 grams and end weight 21 20 grams, each added weight being of the order of 5% of the total weight of the racket. An important feature is maintaining a center of gravity closer to the handle than in a conventional racket and a center of percussion further from the handle than a conventional racket. A player preferring a heavy head may use 25 grams for side weight 16 and 15 or 20 grams for end weight 21. A player who prefers a light head may use 15 grams for side weight 16 and 25 grams for end weight 21. Thus an acceptable range of weights is 3% to 8% of the total racket weight and preferably about 5%. A 430 gram racket according to the invention may feel no different than a 400 gram regular racket because the center of gravity is nearer the handle portion in the invention.

Acceptable limits for the center of gravity is within 12 to 13 inches from the handle end and for the center of percussion 22 to 23 inches from the handle end for a 27-inch game racket meaning a percentage of racket length of 12/27 to 13/27 for center of gravity and 22/27 to 23/27 for the center of percussion. The preferred 4¾ inch pivot point from the end of the handle may be larger depending on how much is added to the end of a 27 inch racket to accommodate end weight 21.

There has been described novel apparatus and techniques for appreciably improving the performance of a game racket by matching its characteristics to the dynamic characteristics of the human arm. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. In a game racket having at least a head portion with a top, bottom and two sides and a handle portion the improvement comprising, side weight means located at one side only of the head portion for reducing the strain on the anatomy of the arm when a player makes an off-center hit with the side weight means up when the hit occurs, and handle weight means located in said handle portion and coacting with said side weight means for establishing the center of gravity of said game racket at a point closer to the end of the handle portion than to the tip of the head portion and a center of percussion relative to a center of rotation in said handle portion located between the tip of the head portion and the midline of the head portion for reducing the strain on the anatomy of the arm when an off-center hit occurs on the tip side of the head midline.

2. The improvement in accordance with claim 1 wherein said side weight means embraces the head midline.

3. The improvement in accordance with claim 2 wherein said handle weight means is located at the end of said handle portion.

4. The improvement in accordance with claim 1 and further comprising, means for establishing the stiffness of said game racket between said handle portion and the center line of said head portion greater than the stiffness between said center line and the head tip.

5. The improvement in accordance with claim 1 wherein said center of gravity is substantially within the range of 12/27 to 13/27 the racket length from the end of said handle portion and said center of percussion is substantially within the range of 22/27 to 23/27 the racket length from the end of said handle portion.

6. The improvement in accordance with claim 5 wherein said handle weight means and said side weight means each has a weight substantially within the range of 3% to 7% the total weight of said game racket.

7. The improvement in accordance with claim 1 wherein said handle weight means and said side weight means each has a weight substantially within the range of 3% to 7% the total weight of said game racket.

8. In a game racket having at least a head portion with top, bottom and two sides and a handle portion the improvement comprising, side weight means located at one side only of the head portion for reducing the strain on the anatomy of the arm when a player makes an off-center hit with the side weight means up when the hit occurs, and gripping means on said handle portion for guiding the hand of a player to grip said handle portion so that said side weight means is always on top when normally stroking.

9. The improvement in accordance with claim 8 and further comprising, handle weight means located in said handle portion and coacting with said side weight means for establishing the center of gravity of said game racket at a point closer to the end of the handle portion than to the tip of the head portion and a center of percussion relative to a center of rotation in said handle portion located between the tip of the head portion and the midline of the head portion for reducing the strain on the anatomy of the arm when an off-center hit occurs on the tip side of the head midline.

* * * * *